US008776888B2

(12) United States Patent
Braekke

(10) Patent No.: US 8,776,888 B2
(45) Date of Patent: Jul. 15, 2014

(54) VALVE FOR WELLBORE APPLICATIONS

(75) Inventor: Kristoffer Braekke, Stavanger (NO)

(73) Assignee: I-Tec AS (NO)

( * ) Notice: Subject to any disclaimer, the term of this patent is extended or adjusted under 35 U.S.C. 154(b) by 280 days.

(21) Appl. No.: 13/060,300

(22) PCT Filed: Aug. 25, 2009

(86) PCT No.: PCT/NO2009/000297
§ 371 (c)(1),
(2), (4) Date: May 10, 2011

(87) PCT Pub. No.: WO2010/024687
PCT Pub. Date: Mar. 4, 2010

(65) Prior Publication Data

US 2011/0204273 A1 Aug. 25, 2011

(30) Foreign Application Priority Data

Aug. 25, 2008 (NO) ..... 20083659

(51) Int. Cl.
*E21B 34/00* (2006.01)

(52) U.S. Cl.
USPC ..... 166/332.1; 166/332.4; 251/318

(58) Field of Classification Search
USPC ..... 166/332.1, 332.4, 334.4, 177.4, 177.5; 251/318, 319, 324, 297
See application file for complete search history.

(56) References Cited

U.S. PATENT DOCUMENTS

| | | | | |
|---|---|---|---|---|
| 2,906,944 | A | 9/1959 | Lebourg | |
| 3,768,562 | A * | 10/1973 | Baker | 166/289 |
| 3,811,500 | A | 5/1974 | Morrisett et al. | |
| 4,530,485 | A * | 7/1985 | Yonker et al. | 251/93 |
| 4,669,541 | A | 6/1987 | Bissonnette | |
| 6,763,892 | B2 | 7/2004 | Kaszuba | |
| 2003/0183392 | A1 | 10/2003 | Garay et al. | |
| 2005/0034875 | A1 | 2/2005 | McLoughlin et al. | |
| 2008/0236819 | A1 * | 10/2008 | Foster et al. | 166/255.2 |

FOREIGN PATENT DOCUMENTS

WO WO 2007021198 A1 * 2/2007

OTHER PUBLICATIONS

PCT/NO2009/000297 International Search Report, Nov. 18, 2009 (5 p.).
Norwegian Search Report for Norwegian Application No. 20083659, Feb. 26, 2009 (3 p.).

* cited by examiner

*Primary Examiner* — Nicole Coy
*Assistant Examiner* — Taras P Bemko
(74) *Attorney, Agent, or Firm* — Conly Rose P.C.

(57) ABSTRACT

The present invention provides a robust, durable and reliable cylindrical valve having closable, radially extending openings for use in cementing, injection, including hydraulic fracturing, and production in wells having high pressures and large pressure differences. The valve may comprise scraping rings in order to remove deposits and the like when it is to be closed after use. Magnets or other suitable means indicates whether the valve is in an open or closed position.

6 Claims, 4 Drawing Sheets

VALVE FOR WELLBORE APPLICATIONS

CROSS-REFERENCE TO RELATED APPLICATIONS

This application is a 35 U.S.C. §371 national stage application of PCT/NO2009/000297 filed Aug. 25, 2009, which claims the benefit of Norwegian Application No. 20083659 filed Aug. 25, 2008, both of which are incorporated herein by reference in their entireties for all purposes.

STATEMENT REGARDING FEDERALLY SPONSORED RESEARCH OR DEVELOPMENT

Not applicable.

BACKGROUND

1. Field of the Invention

The present invention concerns a sliding sleeve valve for production, injection and cementing in wells in geological strata.

2. Related and Prior Art

Production of oil and gas, geothermal applications and drilling of wells for water involves drilling through rock, soil, or other geological formations. Oil/condensate, gas, water, geothermally heated water etc. is hereinafter referred to as production fluid, and can, e.g. in production of hydrocarbons and in geothermal applications, comprise several phases. The formations containing production fluids are usually divided into layers or strata. The drilling may occur vertically through one or more strata in order to reach the desired layer, and then possibly horizontally along one or more strata to provide as efficient wells as possible.

Drilling in geological strata is done by rotating a drill bit at the end of a drill string and force it in the desired direction through geological layers or strata to form a wellbore. Once a predetermined length of wellbore is drilled, the drill string with the drill bit may be pulled out, and the wellbore may be lined with a steel pipe called a casing or liner. Hence, an outer annular space is formed between the casing and the formation. It is common practice to cement the casing to the formation by filling all or part of the outer annular space with cementing slurry. A fully or partially cemented casing stabilizes the formation, and at the same time makes it possible to isolate certain layers or regions behind the casing for retrieval of hydrocarbons, water or geothermal heat. It is well known to anyone skilled in the art that e.g. epoxy-resin-based cementing slurries in some cases are better suited for the task than cement based mixtures. The terms "cement" and "cementing" are thus to be construed generally as injection of a viscous slurry which then hardens, for the purpose of retaining the casing in the formation, and/or stabilize the formation, and/or create a barrier between different zones, and not exclusively as use of cement.

Cementing tools or valves may be included in the casing at predetermined locations. When a segment of casing is to be cemented, the cementing valve is opened and cement slurry is pumped down the casing, out through the valve-ports, and into the outer annular space. Those skilled in the art will be familiar with the use of suitable plugs, staged cementing in which a first batch of cement is allowed to set before the next batch of liquid slurry is pumped into the annular space above it, thus reducing the hydrostatic pressure from the cement which might otherwise harm or damage a weak formation and other cementing techniques and details.

When a well is drilled and lined with a casing, a return flow path from the formation around the casing to the surface must be established. In some instances it is possible to penetrate the casing by setting off explosive charges at one or more predetermined depths to enable radial flow of production fluid from the formation into the casing. In other instances, the casing may be provided with prefabricated holes or slits, possibly combined with sand screens. In many applications, the combination of high hydraulic pressure and relatively porous production strata implies a substantial risk for damage on the formation if explosives are used to penetrate the casing. In these cases, common practice is to use valve sections with radially extending openings which are opened to allow radial flow of cement or epoxy/resin out of the casing for stabilizing and retaining the casing in the formation, for radial flow of injection fluid from inside the pipe to the surrounding formation to maintain or increase the hydraulic pressure in the formation, and/or for radial flow of production fluid from the formation into the casing. Such valve sections designed for inclusion in a tubular, usually by means of threaded couplings of the same kind as used when connecting the pipe segments to a string, are called "valves" in the following for simplicity.

It is also common practice to insert a production pipe into the casing. The inner annular space between the casing and the production pipe is filled with a suitable liquid or mud, and is generally used to maintain and increase hydraulic pressure. The production pipe is in these cases used as return path, and conveys the production fluid to the surface. When using a production pipe within the casing, it is of course also necessary to provide the production pipe with openings or apertures for production fluid, and it may be necessary to isolate production zones from the liquid or mud in the inner annular space between production pipe and casing. Isolating different zones can be accomplished by using mechanical plugs called "packers" rather than by using cementing slurry. Such packers are mainly used in the inner annular space between production pipe and casing, because it may be problematic to achieve sufficient sealing against the formation, especially if the formation is porous. Valves corresponding to the valves described above can be included in the production pipe, and they can be opened once they are localized in a production zone.

During cementing, injection and production in wells as those described above, the possibility for large differential pressures between different zones increase with increasing depth. Production of hydrocarbons from strata deep below a seabed and geothermal applications are both likely to involve large pressures. Isolation of zones and injection of liquid or gas to increase the pressure in the production regions can lead to correspondingly large differential pressures.

Hydraulic fracturing, poses particularly demanding requirements to the design, robustness and durability of the valve. In hydraulic fracturing, a mixture containing e.g. 4% small ceramic particles is injected into the formation at a pressure well above the formation pressure. Fractures in the formation are expanded by the pressure and filled with these particles. When the hydraulic pressure is removed, the particles remain in the fractures and keep them open. The purpose is to improve the inflow of production fluid from the formation.

U.S. Pat. No. 3,768,562 discloses a cementing tool comprising an inner valve sleeve slidably mounted within an outer cylindrical housing. The housing has one or more cementing ports through the wall in the area where the valve sleeve is slidably located. The valve sleeve has matching cementing ports through the wall arranged so that the ports in the valve sleeve will align with the ports in the housing when the sleeve is in its uppermost position within the housing. The valve sleeve and housing have appropriate inner and outer diameters so that the sleeve fits just loosely enough within the housing to allow it to slide in the housing. An inner annular recess runs circumferentially around the interior wall of the housing, intersecting the ports therein. A corresponding outer annular channel runs circumferentially around the exterior wall of the sleeve, in the area of and intersecting the ports therein. If the sliding sleeve is rotated within the housing, the annular recess and channel allow fluid communication through the ports should the ports in the housing and sleeve, respectively, not be exactly in line when the sleeve is moved to its open position.

The sliding sleeve valve of U.S. Pat. No. 3,768,562 can also be included in a production string or any other tubular. As the tubulars (casings, drill strings, production pipes etc) usually are assembled from lengths of pipe that are threaded together, the common way to include such valves or tools is to provide them with a suitable threads at each end, and to include them in the tubular just like the other segments of pipe.

U.S. Pat. No. 4,669,541 discloses a stage collar for cementing a well casing in stages, which can be opened and closed by axial movement of the drill pipe and which provides a direct passage from the drill pipe to the casing annulus without entering the casing interior. A stage collar is shown, which can be opened and closed by axial movement of the drill pipe and, when closed after a cementing operation, is locked closed so as not to be accidentally reopened. The stage collar comprises a ported sleeve adapted to slide between an open position and a closed position, which closing sleeve have ports which are alignable with corresponding ports in the housing. Anti-rotation lugs are received in an axial sleeve recess in the sleeve's outer surface, preventing the closing sleeve from rotating in the ported housing. The stage collar further comprises a separate shift sleeve used to operate or actuate the closing sleeve. An expandable latch ring locks the closing sleeve in the closed position when cementing is complete, and additionally ensures that the shift sleeve, shifting tool and drillpipe cannot be retrieved with axial pipe movement until the stage collar is locked closed.

One problem with known valves of the types discussed above, is that they are not well adapted to applications with gas, vapour and liquid at very high pressures. This limits the use of such valves in environments where gas or vapour under high pressure poses strict requirements to the sealing.

Another problem with prior art valves of the kind discussed above, is that seals can be blown or torn out by the fluid flow when they are opened and there is a large differential pressure over the valve. A valve which is damaged in this manner can no longer be closed. In addition, the pressure shock that arises from such an event may also damage equipment further downstream in the well, i.e. closer to the surface. In order to prevent valves being damaged in this manner, i.e. that the seals are blown or torn out, the pressure difference between different zones in the well must be kept within margins determined by the valves.

U.S. Pat. No. 6,763,892 discloses a sliding sleeve valve, wherein the closing sleeve comprises primary, secondary and tertiary seals acting in cooperative combinations. The valve has a plurality of pressure equalization ports in the sliding sleeve that are intended to communicate with the main body ports prior to the sliding sleeve ports when opening and subsequent to the sliding sleeve ports when closing. This is intended to permit equalization of fluid pressure across the valve before it is fully open or fully closed in order to reduce wear on the seals.

Another problem with known valves is that debris, i.e. larger or smaller particles contaminating the well fluid, is deposited on faces in the valve. Corrosion and scaling may also cause small create small irregularities, possibly causing inferior sealing and reduced operational reliability.

A further problem with prior art valves is that they comprise many parts, making them relatively expensive to manufacture. Valves for high pressure applications may also comprise several high-pressure seals, which are more expensive than seals with lower pressure ratings. Also, some applications, e.g. hydraulic fracturing, require hard surfaces in the ports. Insets of e.g. tungsten carbide may be used, adding to the cost due to the material, and also because hard materials are more expensive to machine when manufacturing the valve.

A further problem with prior art valves is that they lack means to indicate directly if they are in open or closed position.

SUMMARY OF THE INVENTION

The present invention provides a valve part for inclusion in a tubular, comprising a substantially cylindrical outer valve housing having radially extending side ports and an inner sliding sleeve mounted axially movable and rotation locked inside the valve housing, characterized in that the sliding sleeve comprises first sealing means, second sealing means and third sealing means, which sealing means all are disposed around the entire circumference of the sliding sleeve and in contact with an inner sealing surface in the valve housing, that the axial distance between the first and second sealing means is greater than the length of the valve housing comprising the side ports, and that the axial distance between the second and third sealing means is greater than the length of the valve housing comprising the side ports.

Because the sliding sleeve has no ports, a simpler design is achieved. In particular, the cost of adding hard insets in the ports is reduced.

When the valve is closed, the first and second sealing elements seal against the major pressure differential while the third sealing element seals between the sliding sleeve and the valve housing. Hence, in the closed position the pressure differential is divided on two seals. This divides the pressure differential on two seals, reducing the requirements for each seal. In some instances, two seals are required by regulations.

When the valve is opened or closed, the sliding sleeve is passing an intermediate position where the first sealing means seals at one side of the radial ports, and the second and third sealing means seal on the opposite side of the radial ports. As long as the first seal withstands the pressure without being torn out in this position, a small leakage can be permitted in this intermediate position. This permits using less expensive materials to be used in the seals, and only one seal needs to be dimensioned to avoid being blown or torn out by a sudden flow of fluid.

When the valve is fully open, all three sealing means and the end of the sliding sleeve are on the same side of the side ports, whereby fluid is permitted to flow though the radial side ports.

Thus, the present invention provides a robust, durable cylindrical valve, comprising closable, radially extending openings for use in cementing, injection, hydraulic fracturing and production in environments with high pressures and differential pressures. Testing shows that the valve can be opened with a differential pressure of 690 bars (10 000 psi) without seals being blown out, or the valve being damaged in other ways. When testing for purposes of hydraulic fracturing, 6000 liters/min of a mixture containing small ceramic balls were pumped through the valve for 8 hours. The wear was hardly visible.

The valve is provided with scraping rings for removing deposits and the like when it is closed after use. Magnets or other suitable means indicate if the valve is in an open or a closed position.

BRIEF DESCRIPTION OF THE DRAWINGS

The invention will be described in greater detail in the following with reference to the accompanying drawings in which similar numerals refer to similar parts, and where.

DETAILED DESCRIPTION OF A PREFERRED EMBODIMENT

Figure 1:
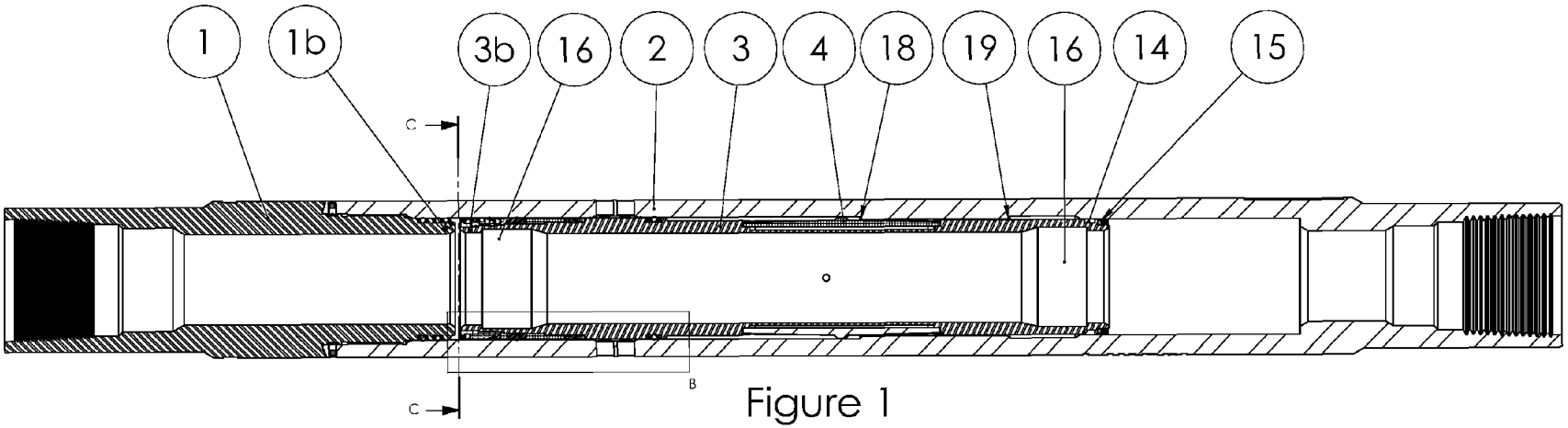
FIG. 1 is a longitudinal cross sectional view of a valve according to the invention.

FIG. 1 is a longitudinal cross sectional view of a valve according to the invention. In FIG. 1, the valve is shown in a closed state. An end part 1 connected to a valve housing 2 form the outer shell of the valve. The valve housing 2 comprises radial side ports 17. An inner sliding sleeve 3 can be moved axially inside the valve housing 2 in order to open or close the radial side ports. As can be best seen in FIG. 2, the sliding sleeve 3 has no ports. Rather, the edge of the sleeve 3 is moved past the housing ports 17 to reach the open position. The inner sliding sleeve 3 is prevented from rotating in the valve housing 2 because it may become necessary to rotate an activating tool (not shown) if it should become stuck.

In FIG. 1, a flexible latch ring 4 connected to the sliding sleeve 3 abuts an inner shoulder 18 along a circumference of the valve housing 2. In order to open the valve, the sliding sleeve 3 must be pulled towards the ring 4 (to the right in FIG. 1) with sufficient force to compress the latch ring 4 radially. A corresponding shoulder 19 is provided for keeping the sliding sleeve 3 in its open position by means of the same latch ring 4. Hence, the latch ring 4 prevents the sliding sleeve 3 from being swept along with fluid flowing in the central bore, and thus from being opened or closed unintentionally.

At the right hand side of FIG. 1, a support ring 14, a scraping ring 15 and a groove 16 for an opening-closing tool. The activating tool (not shown) is inserted into the pipe to move the sliding sleeve 3 between the closed and the open position.

The valve housing 2 and sliding sleeve 3 can each be provided with a label (1*b*, 3*b*), e.g. fixed permanent magnets. When the valve is closed, as shown in FIG. 1, the distance between the two labels/permanent magnets less than when the valve is open. A difference between e.g. 30 mm and 200 mm between these labels or permanent magnets is relatively easy to detect, and can be used as an indication of whether the valve is open or closed.

Figure 2:
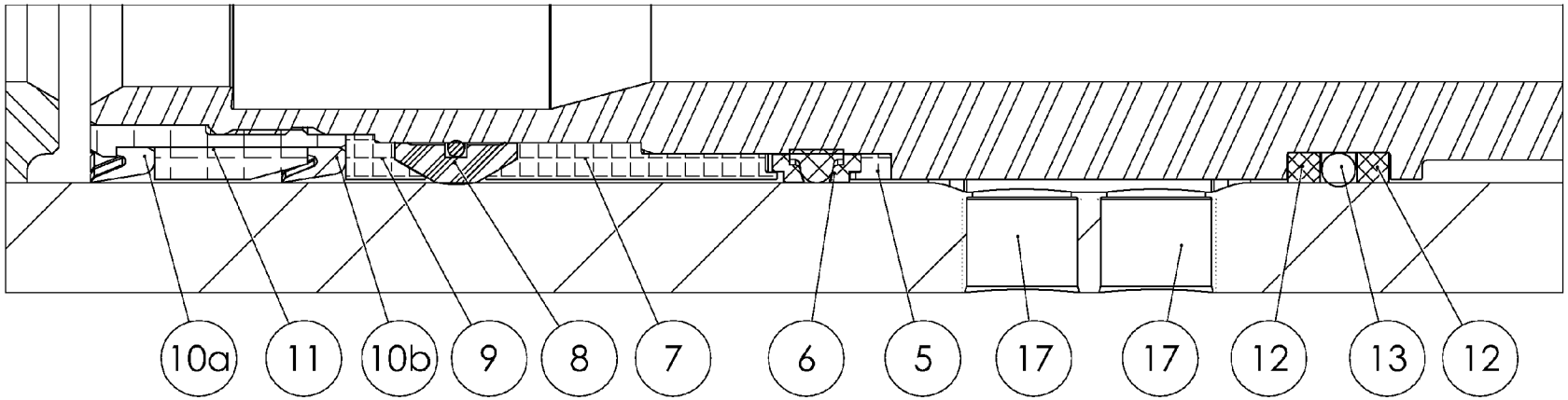
FIG. 2 shows the region around the valve openings in detail.

FIG. 2 is an enlarged view of the section marked "B" in FIG. 1. The mounting rings 5, 7 and 9 retain the seals 6 and 8. When the valve is opened by moving the sliding sleeve 3 to the right in FIGS. 1 and 2, the seal 6 will have passed the radial side ports 17 while the seal 8 still seals against the inner surface of the valve housing 2. The seal 8 may advantageously be manufactured from a stiffer material than the seal 6, and it is retained such that it is not torn out by the pressure difference across it when the seal 6 is on one side and the seal 8 is on the other side of the radial side ports 17.

The side ports 17 can be designed with different diameters for different purposes, e.g. with larger diameters for hydraulic fracturing than for production. The inner surfaces of the valve may also be hardened, e.g. for the purpose of hydraulic fracturing.

Figure 4:
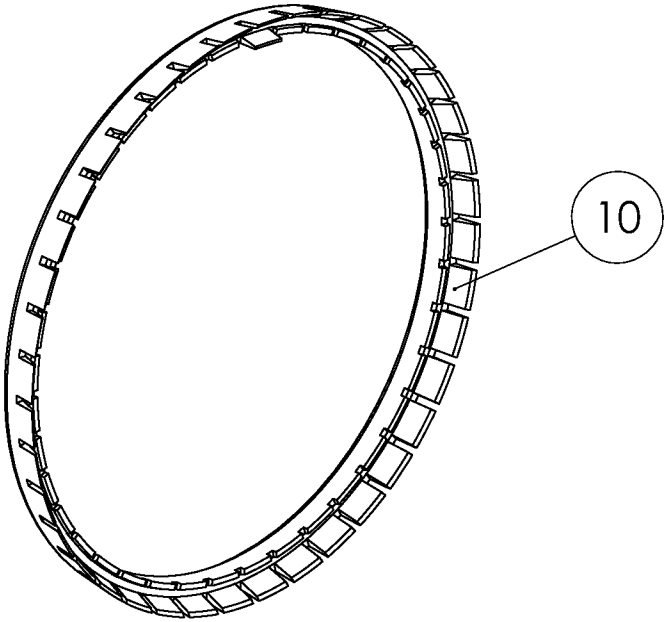
FIG. 4 is an isometric view of a scraping ring.

Scraping rings 10 (10*a*, 10*b*) remove deposits and scaling from the inner surface of the valve housing 2 when the valve has been open for a period of time and is to be closed. An isometric view of a scraping ring 10 is shown in FIG. 4, where it is apparent that the scraping ring 10 comprises scraping lobes separated by notches in the ring. The scraping rings 10*a* and 10*b* in FIG. 2 are both of the type shown in FIG. 4, but rotated relative to each other such that the lobes of ring 10*b* overlaps the notches on ring 10*a* and scrapes the parts of the valve housing 2 that is not scraped by the lobes on scraping ring 10*a*

The nut 11 is threaded to the sliding sleeve 3, and retains the parts 5-10 described above. Support rings 12 retain a seal 13, sealing the valve opposite the side ports 17 relative to the seals 6 and 8, i.e. such that the side ports 17 are axially localized between the seals 6 and 13.

The side ports can be manufactured from a hard material, e.g. tungsten carbide, such that the valve withstands the wear from the ceramic balls used in hydraulic fracturing.

Figure 3:
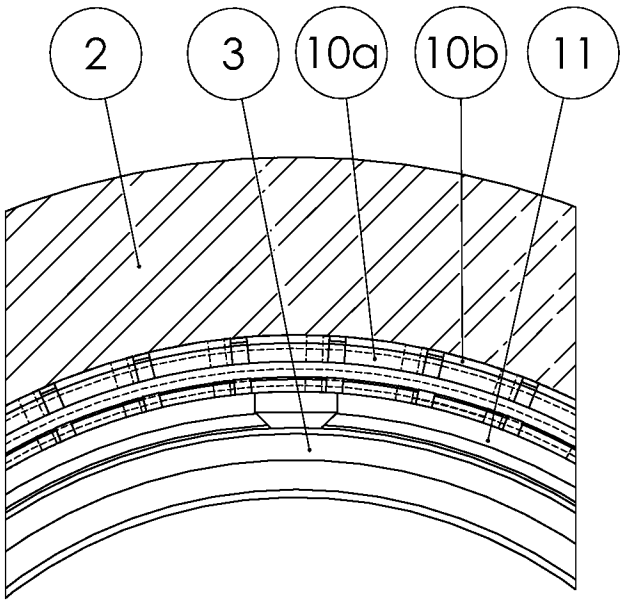
FIG. 3 shows the region around the scraping rings seen from the end of the valve.

FIG. 3 shows a cross section of the valve through C-C on FIG. 1. The sliding sleeve 3 is slidably mounted in the valve housing 2, and overlapping scraping rings 10 are retained on the sliding sleeve 3 by the nut 11.

FIG. 4 shows a scraping ring 10 for mounting on the sliding sleeve 3 in order to scrape off deposits and the like to ensure sufficient sealing.

The invention according to the accompanying claims, described in detail above, thereby solves a number of the problems of prior art.

The invention claimed is:

1. A valve for inclusion in a tubular, comprising:

a substantially cylindrical outer valve housing having a central axis and a plurality of radially extending side ports; and an inner sliding sleeve disposed within the outer valve housing, wherein the inner sliding sleeve is rotationally locked relative to the outer valve housing and is configured to move axially relative to the outer valve housing;

the sliding sleeve further comprising a first sealing means, a second sealing means axially spaced from the first sealing means, and a third sealing means axially spaced from the second sealing means, wherein the second sealing means is axially positioned between the first sealing means and the third sealing means, and wherein each sealing means is disposed about the entire circumference of the sliding sleeve and contacts an inner sealing surface of the valve housing;

wherein the sliding sleeve is configured to move axially between:

a first, closed position with the side ports axially disposed between the second sealing means and the third sealing means;

an intermediate, closed position with the side ports axially disposed between the first sealing means and the second sealing means; and a second, open position with the entire sliding sleeve and each sealing means axially disposed on the same side of the side ports;

wherein the intermediate, closed position is axially disposed between the first, closed position and the second, open position;

wherein the first sealing means, the second sealing means, and the third sealing means are each mounted on the sliding sleeve and are configured to move axially with the sliding sleeve.

2. The valve of claim 1, wherein the first sealing means is made of a first material, the second sealing means is made of a second material, and the third sealing means is made of a third material, wherein the first material is stiffer than the second material and the third material.

3. The valve of claim 1, wherein the first sealing means is retained and configured to seal against a greater pressure differential than the second and third sealing means.

4. The valve of claim 1, wherein:

the sliding sleeve is fixed to a radially flexible latch ring abutting a first inner shoulder on the inner sealing surface of the valve housing when the valve is in the first, closed position, and abutting a second inner shoulder on the inner sealing surface of the valve housing when the valve is in the second, open position; and the axial force required to move the sliding sleeve between the first, closed position and the second, open position must be sufficient to overcome a radial spring force from the latch ring.

5. The valve of claim 1, further comprising a scraping ring radially disposed between the sliding sleeve and the inner sealing surface of the valve housing.

6. The valve of claim 1, wherein:

the sliding sleeve comprises a first labeling means;

the valve housing is rigidly secured to a second labeling means; and the axial distance between the first labeling means and the second labeling means indicates whether the sliding sleeve opens or closes for the radial side ports.

* * * * *